US005345845A

United States Patent [19]

Myers

[11] Patent Number: 5,345,845

[45] Date of Patent: Sep. 13, 1994

[54] RIGHT ANGLE TORQUE TRANSMISSION TOOL

[76] Inventor: Christopher A. Myers, 8708 Camino San Martin SW., Albuquerque, N. Mex. 87121

[21] Appl. No.: 123,803

[22] Filed: Sep. 20, 1993

[51] Int. Cl.[5] ..... B25B 17/00

[52] U.S. Cl. ..... 81/57.29; 403/56; 403/291; 81/177.85

[58] Field of Search ..... 81/57.12, 57.13, 57.28, 81/57.29, 121.1, 124.3, 177.85, 477, 177.85, 177.6, 177.7, 177.8, 177.75; 403/56, 180, 181, 291

[56] References Cited

U.S. PATENT DOCUMENTS

| | | | |
|---|---|---|---|
| 685,544 | 10/1901 | Weimar | 81/57.29 |
| 1,346,716 | 7/1920 | Lee | 81/57.29 |
| 3,430,510 | 3/1969 | Hendrickson | 81/57.29 X |
| 3,889,343 | 6/1975 | Miller et al. | 81/433 X |
| 4,322,989 | 4/1982 | Garolis | 81/57.29 X |
| 4,328,720 | 5/1982 | Shiel | 81/177.85 X |
| 5,033,528 | 7/1991 | Volcani | 403/56 X |

*Primary Examiner*—D. S. Meislin
*Attorney, Agent, or Firm*—E. Michael Combs

[57] ABSTRACT

A torque transmission tool is arranged to direct torque application from a torque wrench to an associated fastener. To this end, an elongate housing is arranged to receive torque from a first end of the housing and direct such torque through gear inter-engagement to a driven shaft having a through-extending polygonal bore arranged to receive various inserts therewithin for directing torque transmission to various tools and fasteners.

1 Claim, 4 Drawing Sheets

FIG. 3
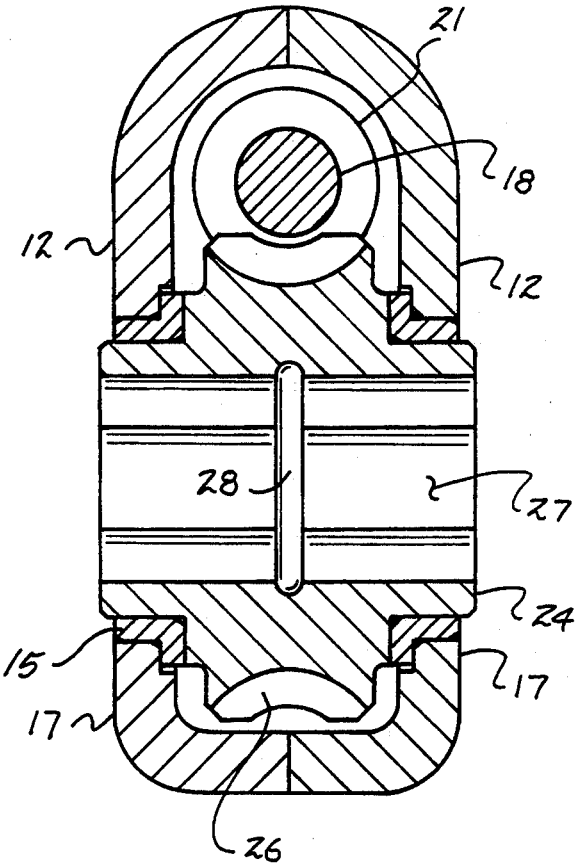
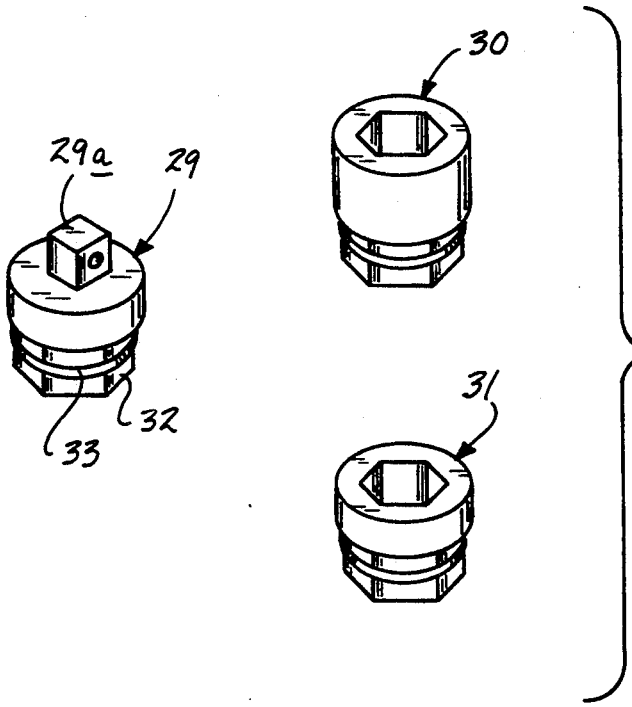
FIG. 4

RIGHT ANGLE TORQUE TRANSMISSION TOOL

BACKGROUND OF THE INVENTION

1. Field of the Invention

The field of invention relates to tool drive structure, and more particularly pertains to a new and improved right angle torque transmission tool wherein the same is directed to apply torque through a right angle from a drive tool to a fastener structure.

2. Description of the Prior Art

Right angle drive tools have been indicated in the prior art such as exemplified by the U.S. Pat. No. 4,913,007 including angle drive structure employing integral joint interconnection through the driven shaft.

U.S. Pat. No. 4,907,476 sets forth a further example of a socket wrench having a drive handle arranged to drive an output shaft orthogonally relative to the drive shaft.

The instant invention attempts to overcome deficiencies of the prior art by providing for an integral housing having an output shaft, including a polygonal bore arranged to receive various inserts therewithin and in this respect, the present invention substantially fulfills this need.

SUMMARY OF THE INVENTION

In view of the foregoing disadvantages inherent in the known types of drive tool structure now present in the prior art, the present invention provides a right angle torque transmission tool wherein the same is arranged to direct torque orthogonally from a drive shaft to a driven shaft. As such, the general purpose of the present invention, which will be described subsequently in greater detail, is to provide a new and improved right angle torque transmission tool which has all the advantages of the prior art drive tool apparatus and none of the disadvantages.

To attain this, the present invention provides a torque transmission tool arranged to direct torque application from a torque wrench to an associated fastener. To this end, an elongate housing is arranged to receive torque from a first end of the housing and direct such torque through gear interengagement to a driven shaft having a through-extending polygonal bore arranged to receive various inserts therewithin for directing torque transmission to various tools and fasteners.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved right angle torque transmission tool which has all the advantages of the prior art drive tool apparatus and none of the disadvantages.

It is another object of the present invention to provide a new and improved right angle torque transmission tool which may be easily and efficiently manufactured and marketed.

It is a further object of the present invention to provide a new and improved right angle torque transmission tool which is of a durable and reliable construction.

An even further object of the present invention is to provide a new and improved right angle torque transmission tool which is susceptible of a low cost of manufacture with regard to both materials and labor, and which accordingly is then susceptible of low prices of sale to the consuming public, thereby making such right angle torque transmission tool economically available to the buying public.

Still yet another object of the present invention is to provide a new and improved right angle torque transmission tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an isometric illustration of various inserts employed by the driven shaft polygonal cavity, as indicated in FIG. 3.

DESCRIPTION OF THE PREFERRED EMBODIMENT

Figure 1:
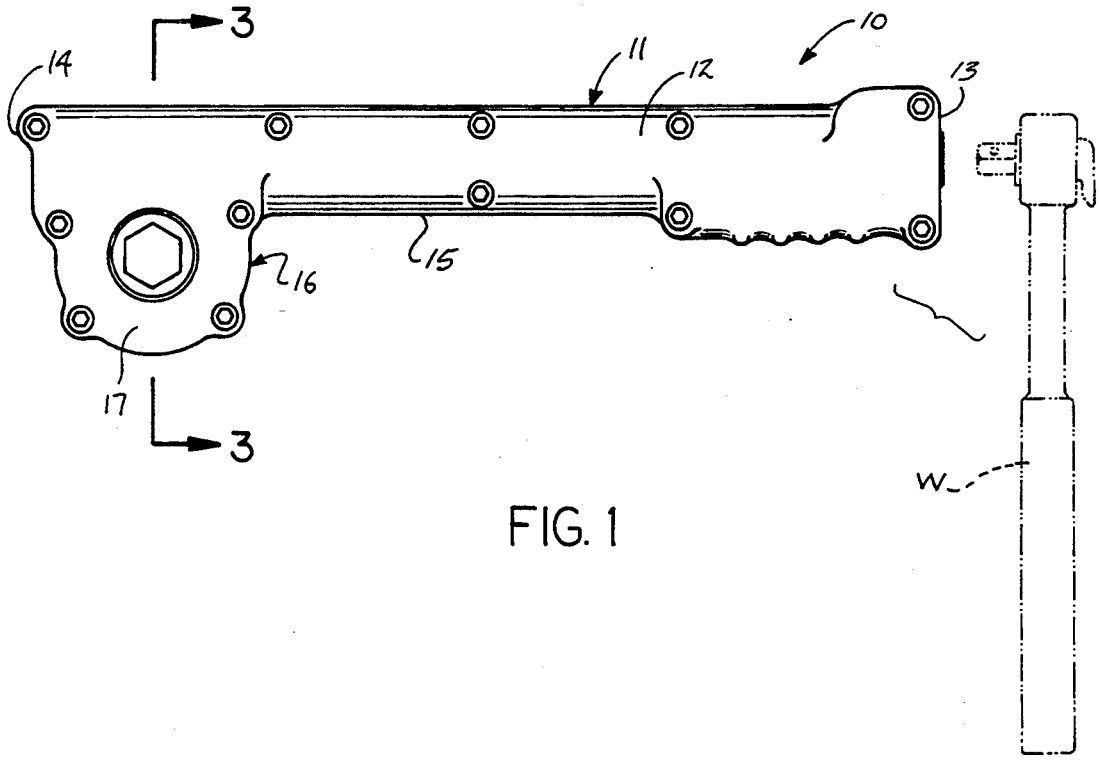
FIG. 1 is an orthographic side view of the invention.
Figure 2:
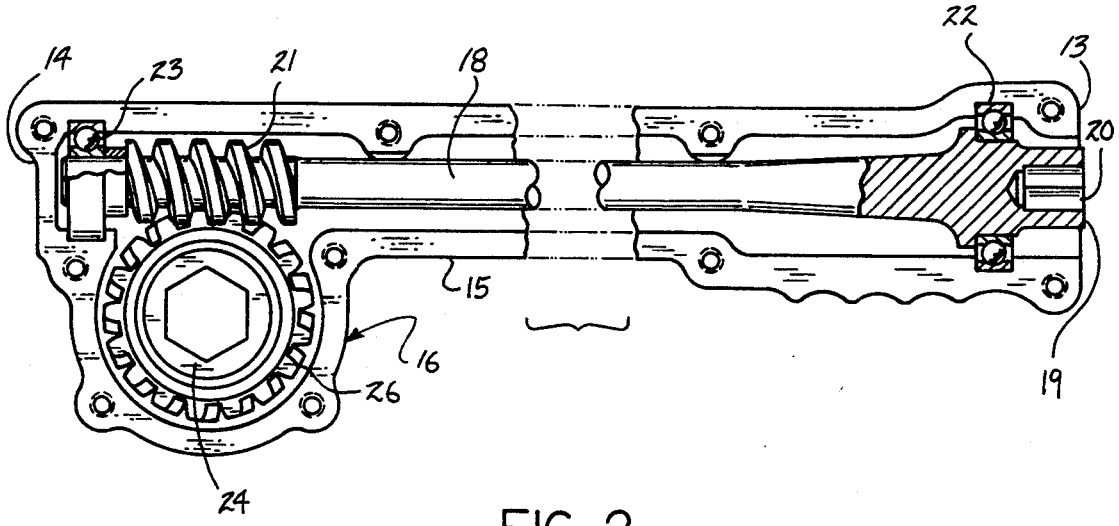
FIG. 2 is an orthographic cross-sectional illustration of the invention, as indicated relative to FIG. 1.

With reference now to the drawings, and in particular to FIGS. 1 to 8 thereof, a new and improved right angle torque transmission tool embodying the principles and concepts of the present invention and generally designated by the reference numeral 10 will be described.

More specifically, the right angle torque transmission tool 10 of the instant invention essentially comprises an elongate housing 11 having housing side walls 12, a housing first end wall 13 spaced from a housing second end wall 14, with a housing bottom wall 15 having an extension housing 16 integrally mounted to the bottom wall extending therefrom in adjacency to the second end wall 14. The elongate housing 11 includes a housing cavity, while the extension housing 16 includes an extension housing cavity, with the extension housing cavity and the elongate housing cavity in communication relative to one another. To this end, a drive shaft 18 mounted medially of the elongate housing 11 includes a shaft first end 19 projecting through the housing first end wall 13, with the shaft first end 19 having a first end socket 20 arranged to receive a wrench "W" to effect rotation and torque application to the drive shaft 18 through the shaft first end 19. A drive gear 21 is mounted to the shaft in adjacency to the shaft second end spaced from the shaft first end. The drive shaft 18 includes a first bearing 22 mounted in adjacency to the shaft first end, while a second bearing 23 is mounted in adjacency to the shaft second end. A driven shaft 24 is positioned within the extension housing 16 rotatably mounted with a driven shaft bearing 25. A driven gear 26 is arranged in concentric orientation relative to the driven shaft 24 fixedly mounted thereto, with the driven gear 26 positioned intermediate the driven shaft opposite ends, with the driven gear 26 in operative communication with the drive gear 21. The driven shaft 24 includes a driven shaft polygonal cavity 27 directed concentrically and coaxially through the driven shaft 24, with the polygonal cavity 27 orthogonally oriented relative to the drive shaft 18. An annular groove 28 is directed onto the driven shaft 27 concentric with the polygonal cavity 27 medially thereof to permit the reception and securement of various inserts to include first, second, and third inserts 29, 30, and 31 of a type as indicated and exemplified by the FIG. 4. The first insert 29 is indicated to include an extension boss **29*a* for receiving various drive sockets thereon. The second insert 30 is arranged to have a first polygonal socket medially therethrough of a first length, while the third insert 31 has a second polygonal socket of a second length less than the first length permitting the inserts 30 and 31 to accommodate various fasteners therewithin of various lengths. Further, each of the inserts 29–31 includes a polygonal shank 32 complementarily received within the polygonal cavity 27. Each polygonal shank 32 further includes a resilient lock ring 33 concentrically mounted about the polygonal shank 32 projecting exteriorly thereof, with the lock ring 33 arranged for reception within the annular groove 28** to permit selective securement of an insert within the polygonal cavity and with the resilient configuration of a lock ring permitting the subsequent removal of an associated insert.

Figure 5:
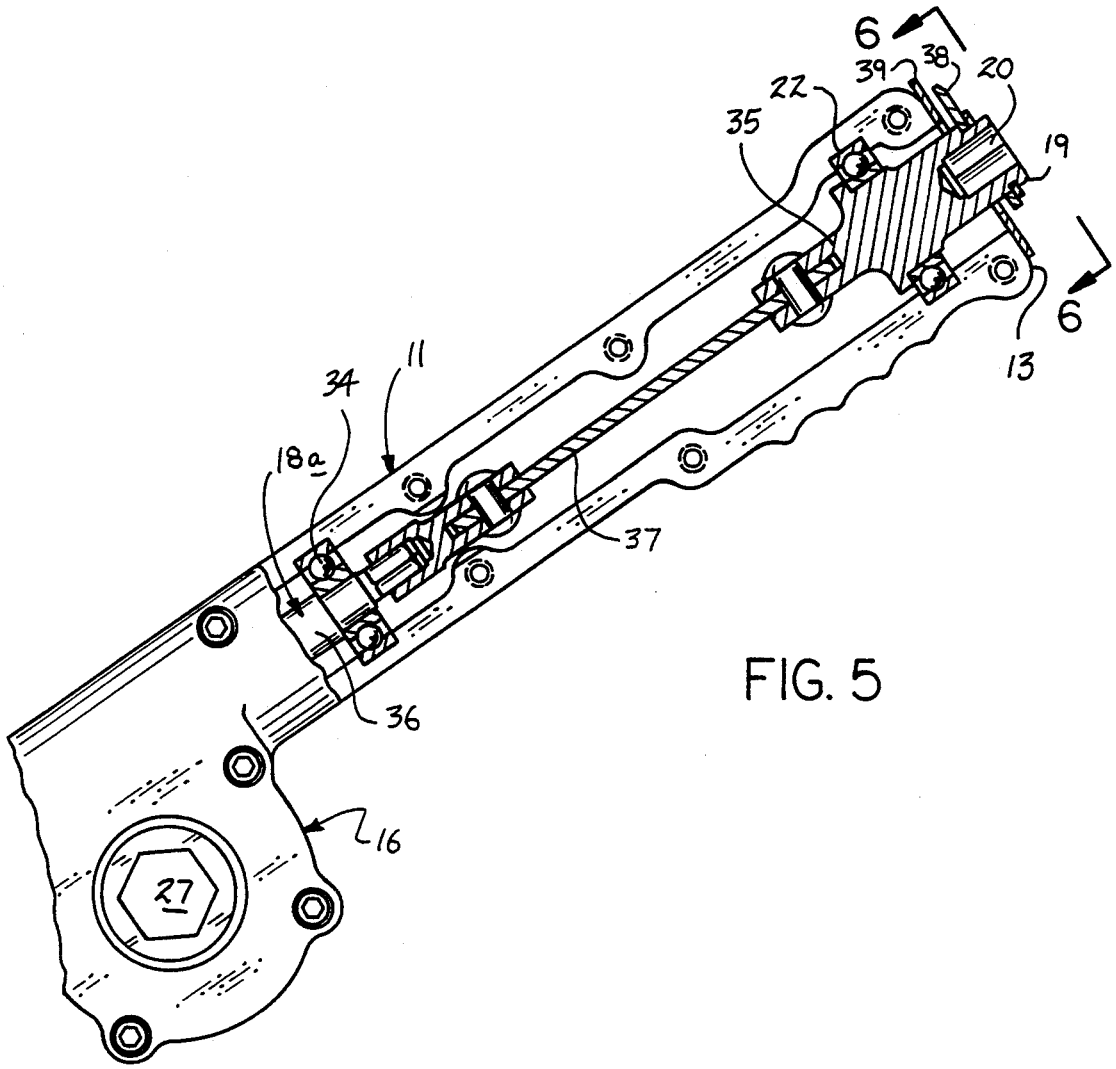
FIG. 5 is an orthographic view, partially in cross-section, indicating a modified drive shaft structure including torque indicator structure associated therewith.
Figure 6:
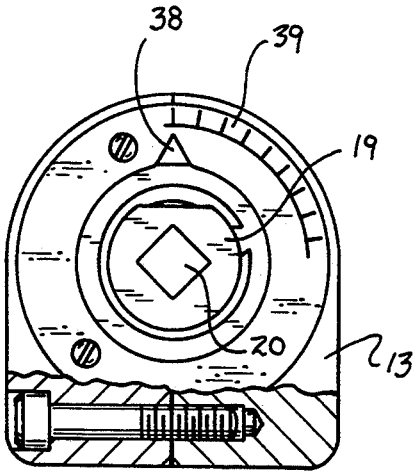
FIG. 6 is an orthographic view, taken along the lines 6—6 of FIG. 5 in the direction indicated by the arrows.

The FIG. 5 indicates the use of a modified drive shaft 18, having a first shaft portion 35 and a second shaft portion 36 arranged in a coaxially aligned spaced relationship relative to one another. The first shaft portion 35 is connected to the second shaft portion 36 by a torsion spring plate 37. As illustrated, an intermediate bearing 34 is mounted to the second shaft portion 36 in spaced adjacency to the second bearing 23 to provide for required support of the second shaft portion 36. An indicator rod 38 is fixedly mounted to the shaft first end 19, as illustrated in FIG. 5, and to that portion projecting beyond the housing first end wall 13. The indicator rod 38 is cooperative with a graduated indicator plate 39 fixedly mounted to the housing first end wall 13, wherein the graduations are in an annular array, as illustrated in FIG. 6, to provide for indication of torque application indicating application upon the indicator plate 39, such that the relative stiffness of the torsion spring plate 37 will accordingly transmit such torque application to an associated fastener through the inserts directed into the polygonal cavity 27. The torque thereto effects rotation of the first and second shaft portions relative to one another and does not permit the desired rotation of the polygonal cavity in relationship to a fastener and the like to be rotated, wherein the indication of torque upon such rotation is indicated upon the graduated indicator plate for relative rotation of the first shaft portion 35 relative to the second shaft portion 36 through the torsion spring plate 37.

Figure 7:
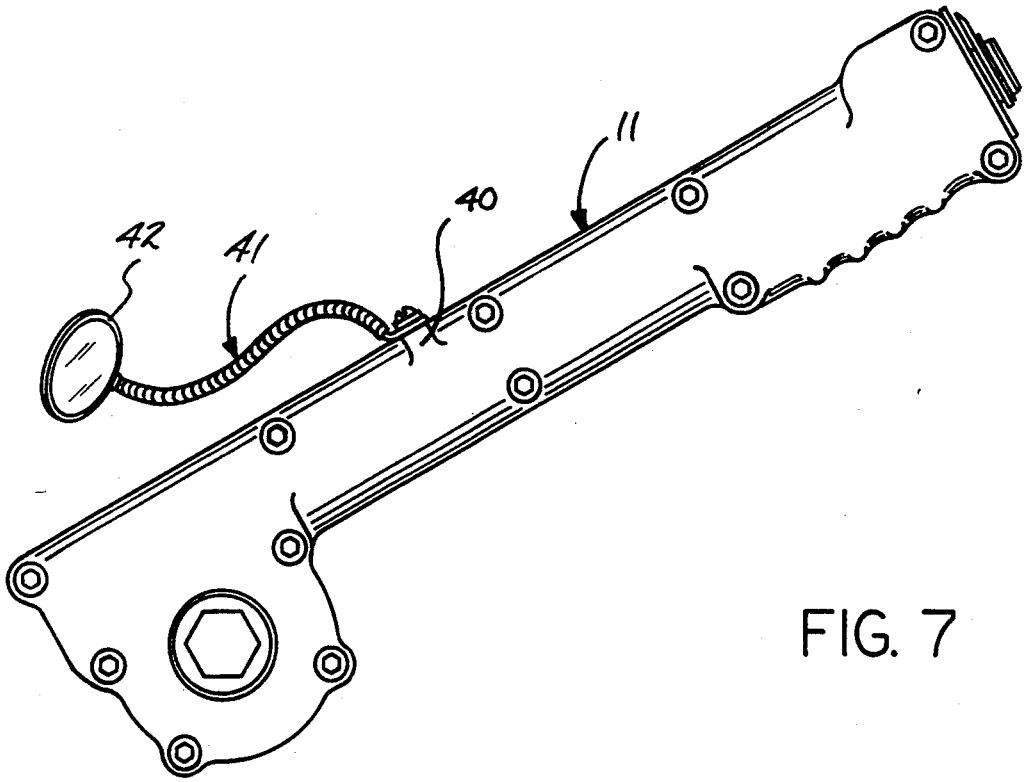
FIG. 7 is an orthographic view of the invention to further include an articulated shaft having a mirror plate.
Figure 8:
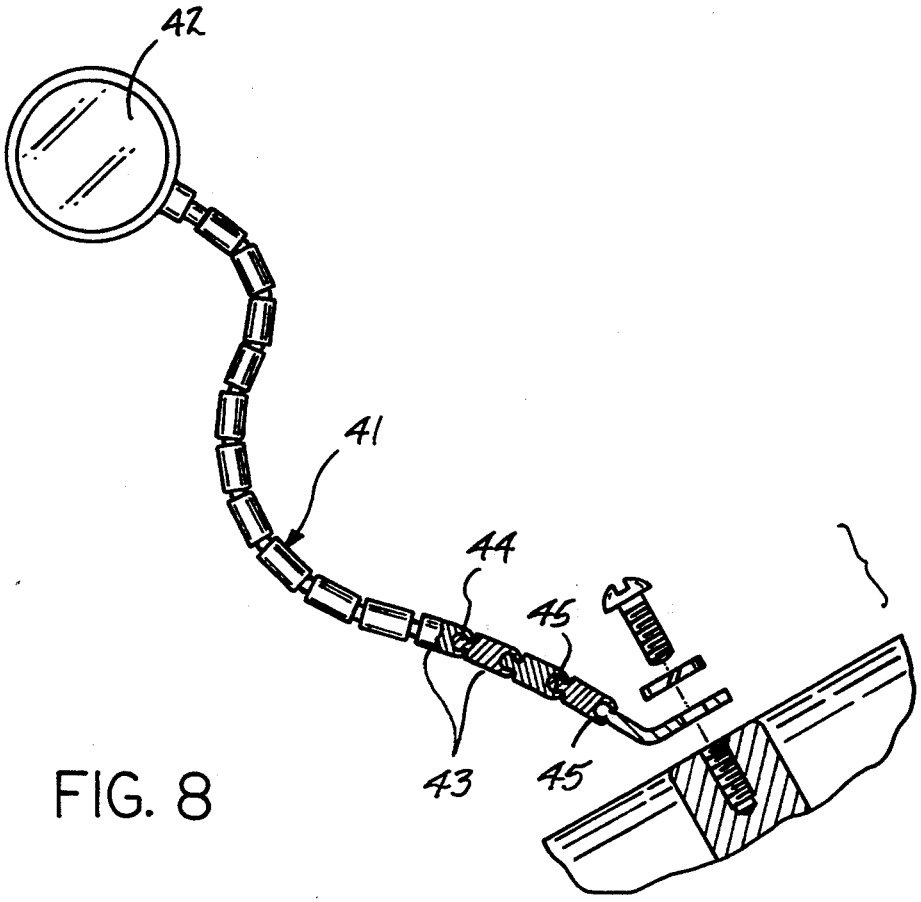
FIG. 8 is an enlarged orthographic view, partially in cross-section, indicating the articulated linkage of the articulated shaft.

The FIGS. 7 and 8 indicate the use of a mounting lug 40 mounted upon the housing 11 to an exterior surface thereof, such that an articulated shaft 41 including an articulated shaft first end mounted to the mounting lug 40 with an articulated shaft second end having secured thereto a mirror plate 42. The articulated shaft 41 is formed of a row of link cylinders 43, with each link cylinder having a link cylinder spherical end 44 received within an adjacent link cylinder spherical socket 45 to provide for intercommunication and pivoting of adjacent link cylinders relative to one another.

It should be noted that the extension housing having extension housing side walls 17 are arranged such that each of the extension housing side walls 17 is coplanar with an adjacent one of the elongate housing side walls 12 to avoid interference of the elongate housing relative to the extension housing. To this end, the extension housing side walls may then project beyond the elongate housing side walls 12 but should at least be coplanar with the elongate housing side walls not having the elongate housing side walls projecting in any event beyond the extension housing side walls.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A right angle torque transmission tool, comprising, an elongate housing, the elongate housing having elongate housing spaced side walls, an elongate housing first end wall, and an elongate housing second end wall spaced from the elongate housing first end wall, and an elongate housing bottom wall, and the elongate housing having an elongate housing cavity and an extension housing fixedly mounted to the elongate housing bottom wall adjacent the elongate housing second end wall, the extension housing having extension housing spaced side walls, and a drive shaft, the drive shaft having shaft first end and a shaft second end, with the shaft first end extending beyond the elongate housing first end wall, and the shaft first end including a shaft first end socket, and a drive gear integrally mounted to the drive shaft in adjacency to the shaft second end, a first bearing rotatably mounting the drive shaft in adjacency to the shaft first end, and a second bearing rotatably mounting the drive shaft in adjacency to the shaft second end, and a driven shaft rotatably mounted through the extension housing, with the driven shaft having a driven shaft gear arranged in surrounding relationship relative to the driven shaft concentric therewith, with the driven gear in operative engagement with the drive gear, the driven shaft including a driven shaft polygonal cavity extending coextensively through the driven shaft, the polygonal cavity orthogonally oriented relative to the drive shaft, and the driven shaft polygonal cavity includes an annular groove concentrically oriented relative to the driven shaft polygonal cavity, with the annular groove oriented medially thereof, and at least one insert arranged for reception within the polygonal cavity, the at least one insert includes a polygonal shank, the polygonal shank complementarily received within the drive shaft polygonal cavity, the polygonal shank further including a resilient annular lock ring concentrically mounted about the polygonal shank, with the resilient lock ring arranged for reception within the annular groove, and the drive shaft includes a first shaft portion extending from the drive shaft first end, and a second shaft portion coaxially aligned with the first shaft portion, with the second shaft portion spaced from the first shaft portion, and the second shaft portion extending to the shaft second end, and an intermediate bearing mounted about the second shaft portion within the elongate housing, with the intermediate bearing arranged in spaced adjacency to the second bearing, and a torsion spring plate fixedly mounted between the first shaft portion and the second shaft portion to permit transmission of torque from the first shaft portion to the second shaft portion, and an indicator rod fixedly mounted to the drive shaft and in adjacency to the shaft first end between the shaft first end and the elongate housing first end wall, and the elongate housing first end wall further including an indicator plate fixedly mounted to the elongate housing first end wall between the indicator rod and the elongate housing first end wall, with the indicator plate including an annular graduated scale concentrically oriented relative to the driven shaft, and a mounting lug fixedly mounted to the elongate housing, and an articulated shaft, the articulated shaft including an articulated shaft first end fixedly mounted to the mounting lug, and an articulated shaft second end, and a mirror plate secured to the articulated shaft second end, and the articulated shaft includes a plurality of link cylinders, each link cylinder having a link cylinder first end and a link cylinder second end, each link cylinder first end having a link cylinder spherical end, and each link cylinder second end having a link cylinder spherical socket, the link cylinder spherical end arranged for reception and within an adjacent link cylinder spherical socket.

* * * * *